US011281127B1

(12) United States Patent
Kouzu

(10) Patent No.: US 11,281,127 B1
(45) Date of Patent: Mar. 22, 2022

(54) IMAGE FORMING APPARATUS

(71) Applicant: TOSHIBA TEC KABUSHIKI KAISHA, Tokyo (JP)

(72) Inventor: Norio Kouzu, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/172,195

(22) Filed: Feb. 10, 2021

(51) Int. Cl.
*G03G 15/16* (2006.01)
*G03G 21/16* (2006.01)

(52) U.S. Cl.
CPC ..... *G03G 15/1615* (2013.01); *G03G 15/161* (2013.01); *G03G 15/162* (2013.01); *G03G 15/1665* (2013.01); *G03G 21/168* (2013.01); *G03G 21/1633* (2013.01)

(58) Field of Classification Search
CPC ..... G03G 15/161; G03G 15/1615; G03G 15/1665; G03G 15/167; G03G 21/1633; G03G 21/168
See application file for complete search history.

(56) References Cited

U.S. PATENT DOCUMENTS 10,915,058 B1 * 2/2021 Kouzu ..... G03G 21/1638
2007/0196125 A1 * 8/2007 Koizumi ..... G03G 15/161 399/101
2009/0129815 A1 * 5/2009 Kouzu ..... G03G 21/168 399/121
2011/0081165 A1 * 4/2011 Kwon ..... G03G 15/0131 399/121
2012/0045264 A1 * 2/2012 Shuhama ..... G03G 21/1633 399/361
2014/0147147 A1 5/2014 Ueno et al.
2016/0170331 A1 * 6/2016 Makita ..... F16H 53/04 399/121

FOREIGN PATENT DOCUMENTS

JP 2006-267548 10/2006
JP 2013-235151 11/2013
JP 2016-095474 5/2016

* cited by examiner

*Primary Examiner* — Carla J Therrien
(74) *Attorney, Agent, or Firm* — Amin, Turocy & Watson, LLP

(57) ABSTRACT

An image forming apparatus includes a rotating body that regulates a movement of a transfer roller in a direction along a rotating shaft of the transfer roller. The rotating body includes a first portion located at a first distance from the rotating shaft of the transfer roller in a direction intersecting the rotating shaft of the transfer roller and a second portion located at a second distance that is nearer than the first distance. The rotating body takes a first position for supporting the transfer roller in a separating position by making the first portion abut on the cover in a state where the side cover is closed. The rotating body takes a second position where the second portion is directed to the cover and the transfer roller is in an abutting position in a state where the side cover is closed.

20 Claims, 12 Drawing Sheets

IMAGE FORMING APPARATUS

FIELD

Embodiments described herein relate generally to an image forming apparatus and a transfer belt assembly.

BACKGROUND

The image forming apparatus includes a dedicated separating member which is used when packing and transporting the image forming apparatus and separates a secondary transfer roller from a transfer belt. Then, in the image forming apparatus, for example, deformation of the secondary transfer roller due to abutment of the secondary transfer roller on the transfer belt for a long period of time is prevented by a dedicated separation member.

DETAILED DESCRIPTION

In general, according to one embodiment, there is provided an image forming apparatus including an apparatus body, a transfer belt, a transfer facing roller, a transfer unit body, a side cover, a transfer roller, a cover, and a first rotating body. An image is formed on the transfer belt. A transfer belt is hung on the transfer facing roller. The side cover is opened and closed with respect to the apparatus body. The transfer roller rotates with respect to the side cover. The cover is located on the transfer unit body or the apparatus body. The cover covers a portion on a side cover side of the transfer belt on an end portion side of the transfer facing roller. The first rotating body regulates a movement of the transfer roller in a direction along a rotating shaft of the transfer roller. The first rotating body includes a first portion located at a first distance from the rotating shaft of the transfer roller in a direction intersecting the rotating shaft of the transfer roller, and a second portion located at a second distance that is nearer than the first distance. The first rotating body rotates around the rotating shaft of the transfer roller. The first rotating body takes a first position for supporting the transfer roller in a separating position by making the first portion abut on the cover in a state where the side cover is closed with respect to the apparatus body. The first rotating body takes a second position where the second portion is directed to the cover and the transfer roller is in an abutting position in a state where the side cover is closed with respect to the apparatus body.

First Embodiment

An image forming apparatus 10 according to the first embodiment will be described with reference to FIGS. 1 to 11.

Figure 1:
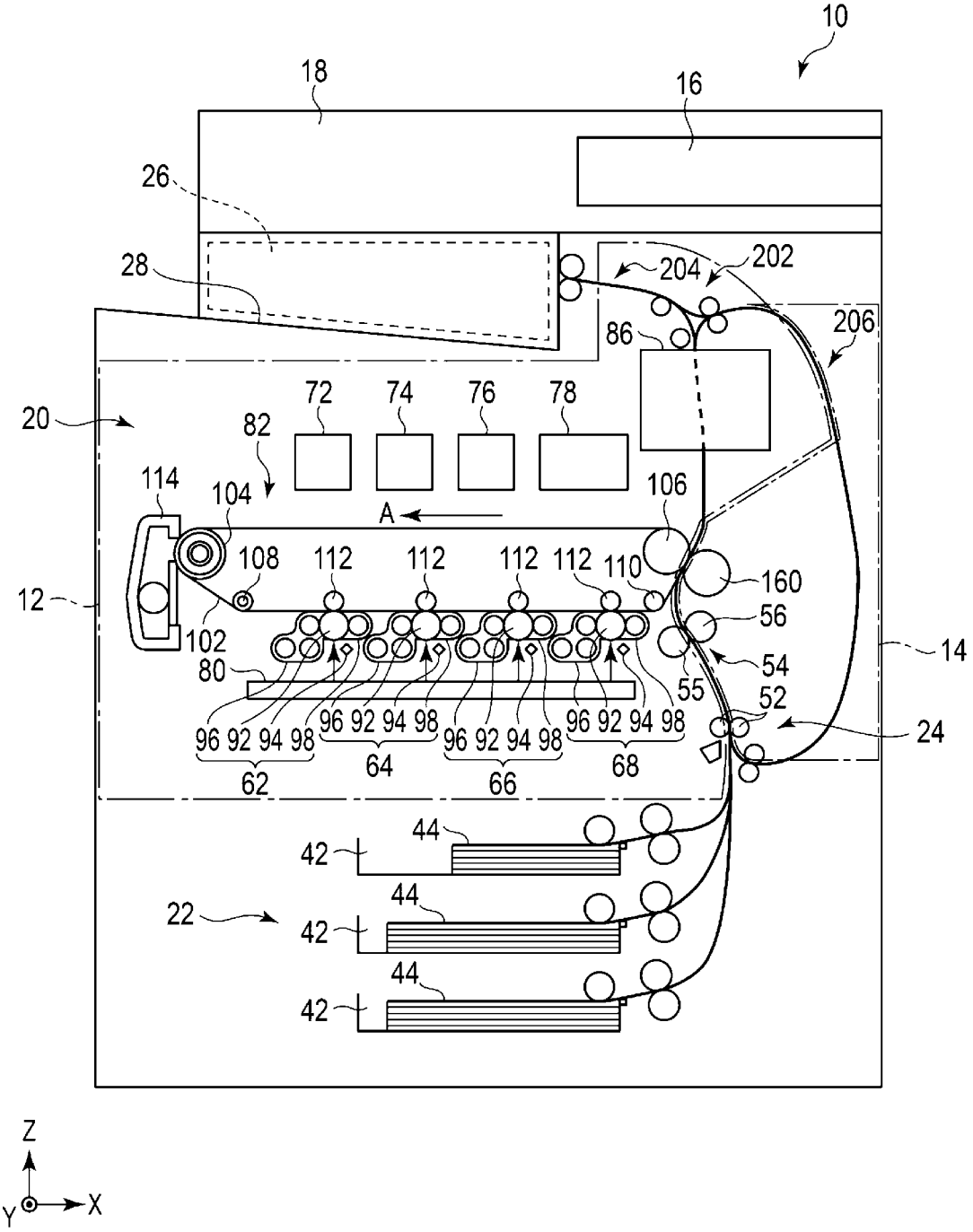
FIG. 1 is a diagram schematically illustrating an overall configuration of an image forming apparatus according to a first embodiment.

FIG. 1 is a schematic view illustrating the overall configuration of the image forming apparatus 10 of this embodiment. A front side of a paper surface illustrated in FIG. 1 is prescribed as the front side of the image forming apparatus 10, and an inner side of the paper surface illustrated in FIG. 1 is prescribed as a rear side of the image forming apparatus 10. In order to explain a relative positional relationship of each part in the image forming apparatus 10, an XYZ Cartesian coordinate system is adopted as illustrated in FIG. 1. The +X-side is the direction from left to right when standing in front (front side of the paper surface in FIG. 1) of the image forming apparatus 10. The +Y-side is a direction from the rear side to the front side of the image forming apparatus 10. The +Z-side is vertically upward direction.

As illustrated in FIG. 1, the image forming apparatus 10 of this embodiment includes an apparatus body 12, a side cover 14, a control panel 16, a scanner unit 18, a printer 20, a sheet supply unit 22, a conveyance unit 24, and a control unit 26.

Figure 2:
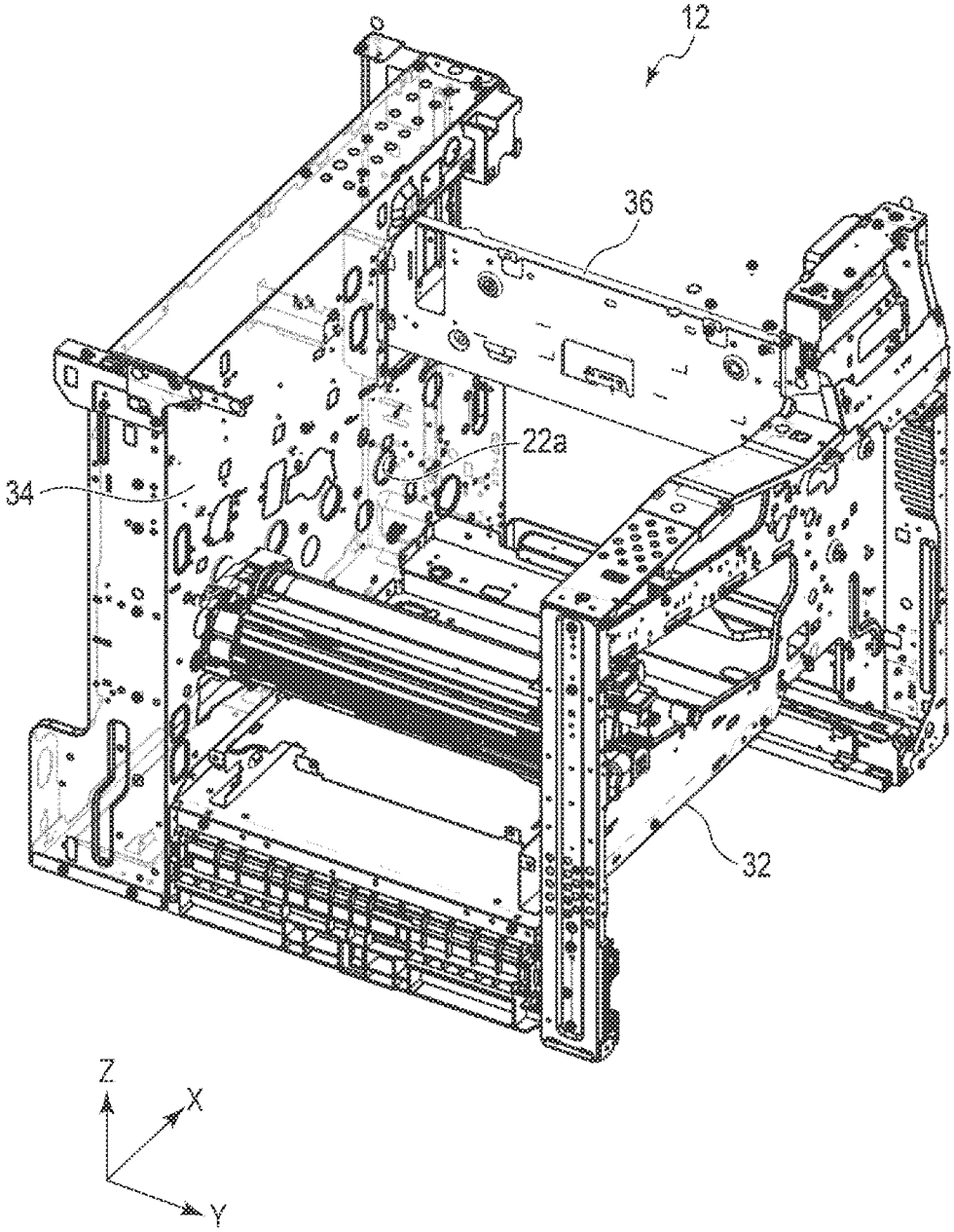
FIG. 2 is a schematic perspective view illustrating an apparatus body of the image forming apparatus according to the first embodiment.
Figure 3:
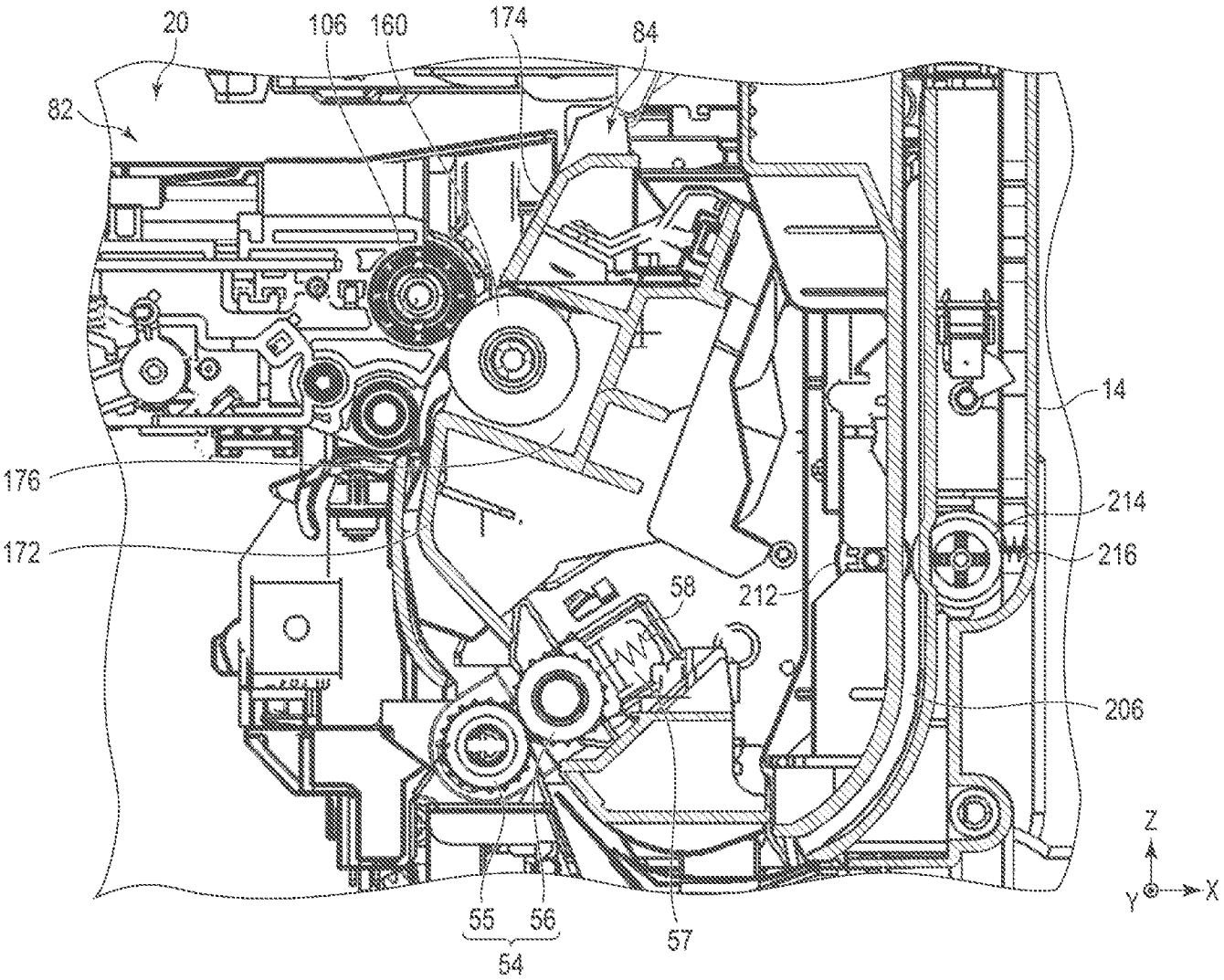
FIG. 3 is a schematic view illustrating a configuration of a part of a printer and a side cover of the image forming apparatus according to the first embodiment as viewed from the front side.
Figure 4:
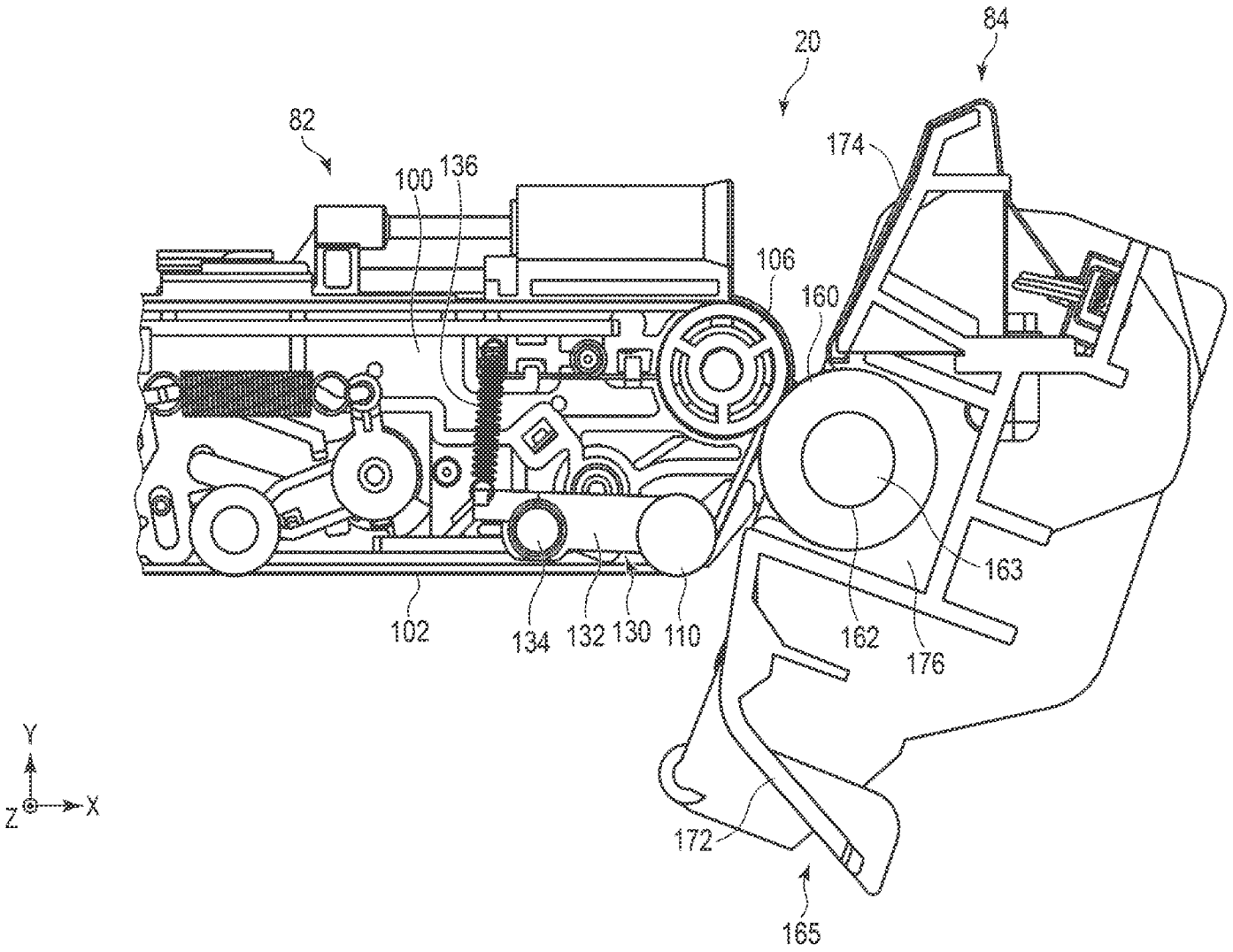
FIG. 4 is a schematic view illustrating a configuration of a part of the printer of the image forming apparatus according to the first embodiment as viewed from the front side.
Figure 5:
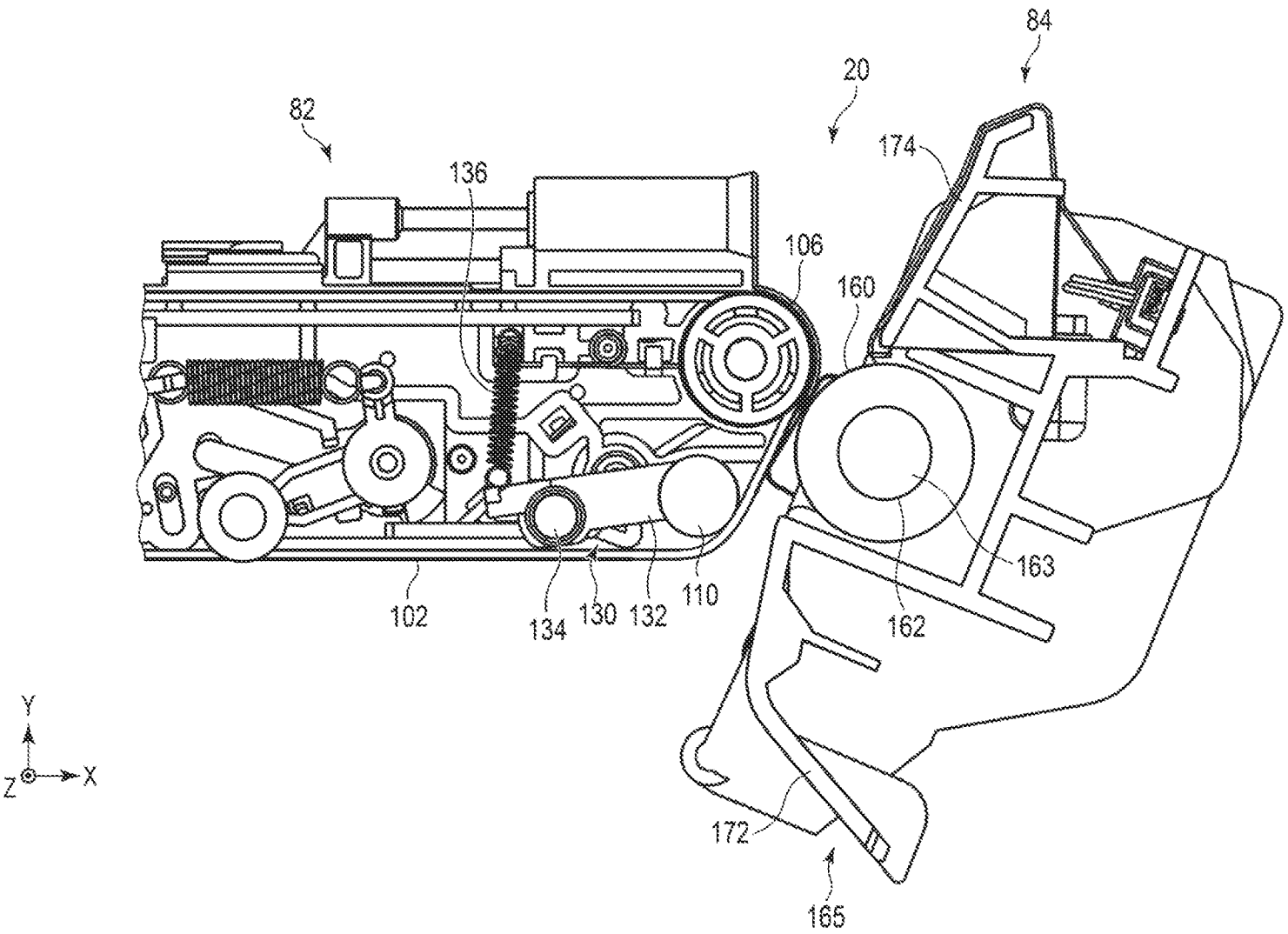
FIG. 5 is a schematic view illustrating a configuration of a part of the printer of the image forming apparatus according to the first embodiment as viewed from the front side.
Figure 6:
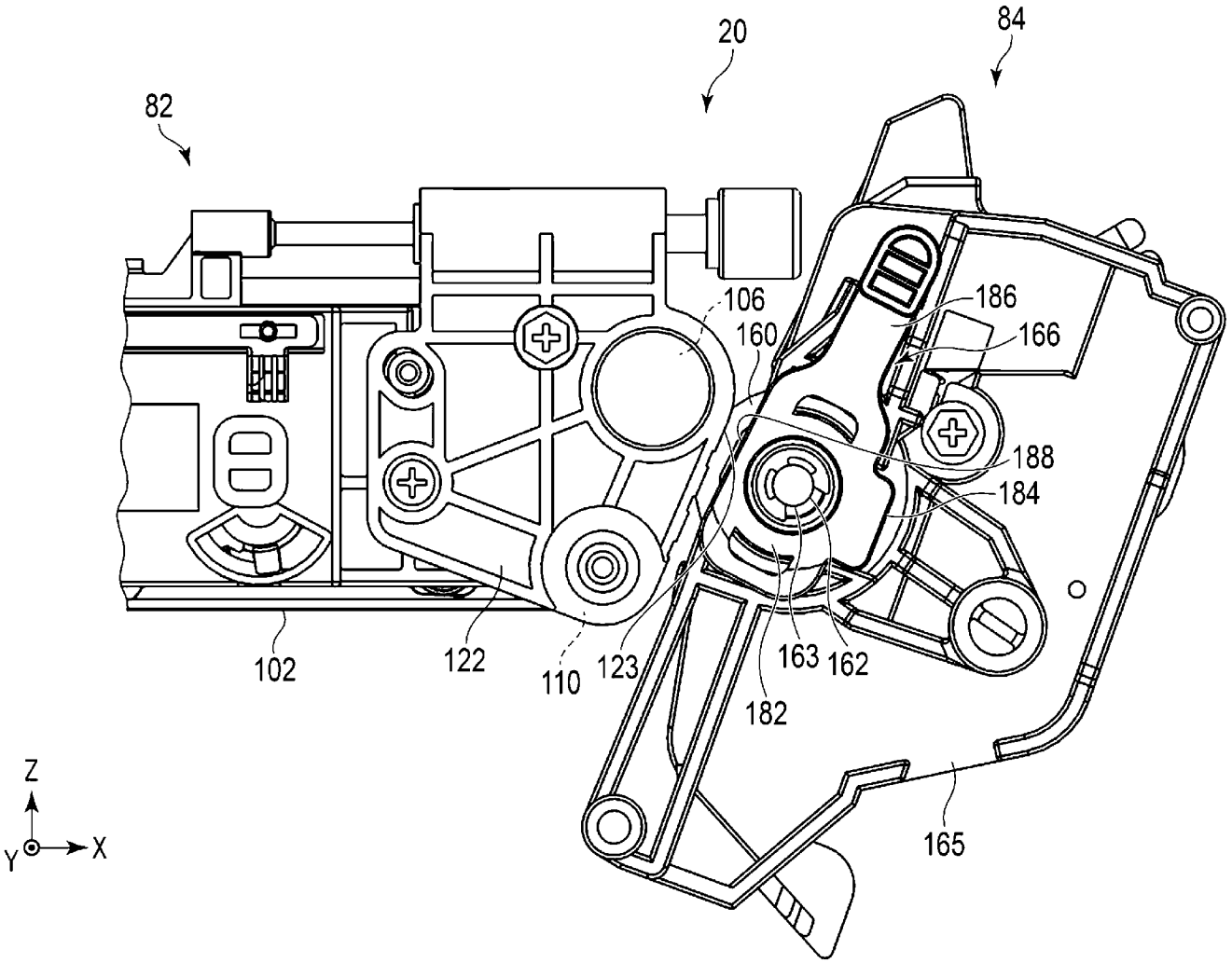
FIG. 6 is a schematic view illustrating a configuration of a part of the printer of the image forming apparatus according to the first embodiment as viewed from the front side.
Figure 7:
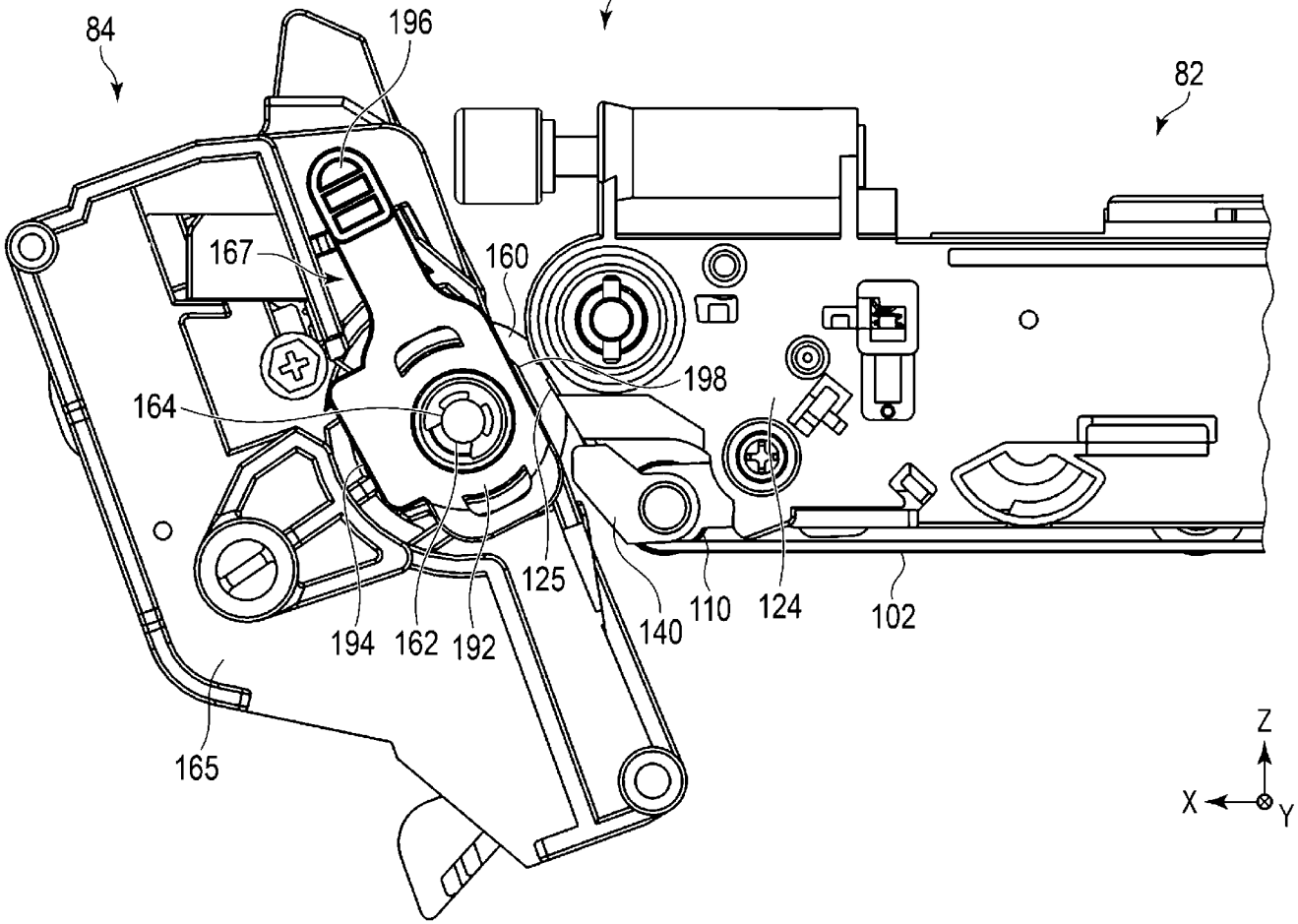
FIG. 7 is a schematic view illustrating a configuration of a part of the printer of the image forming apparatus according to the first embodiment as viewed from the rear side.
Figure 8:
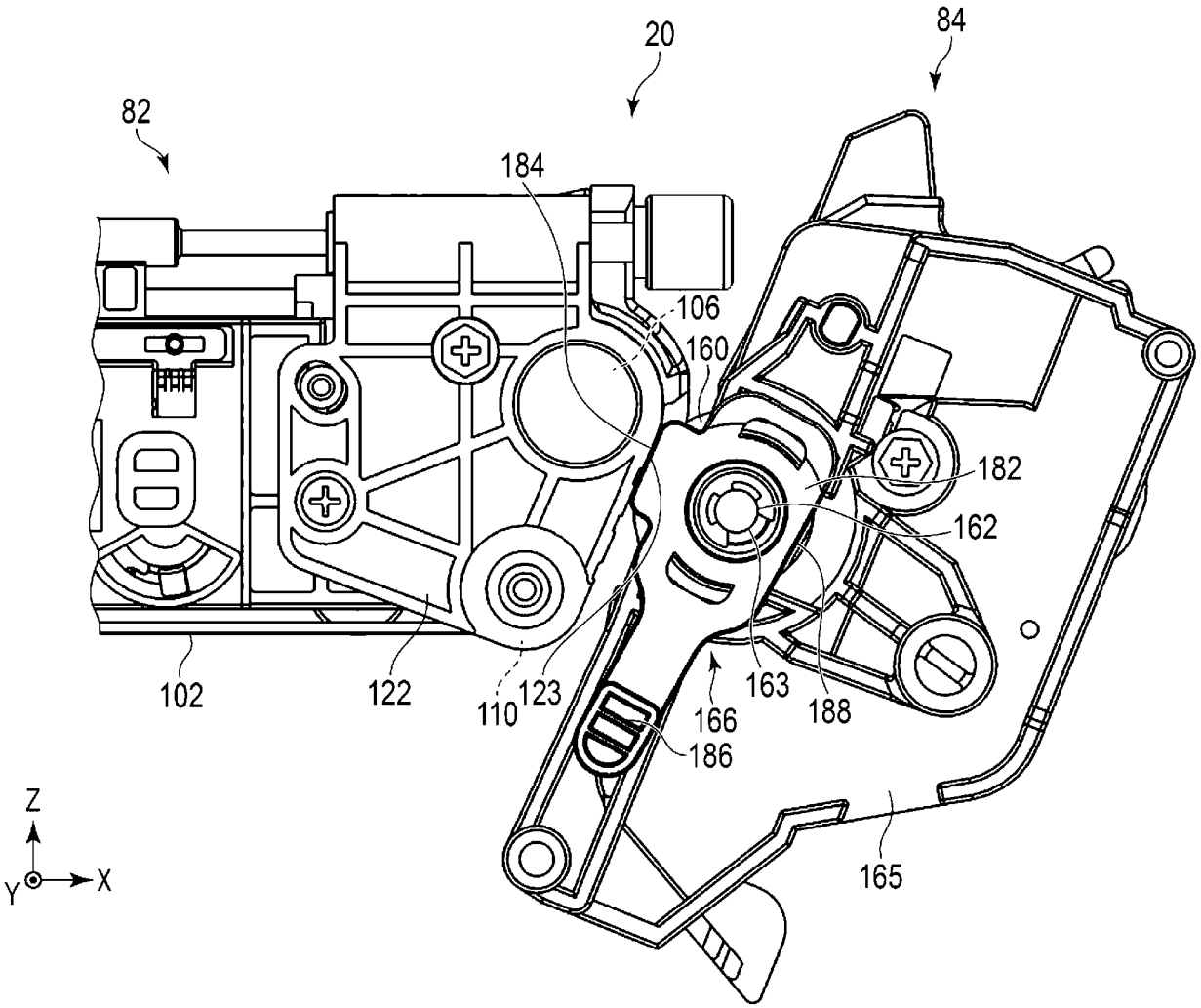
FIG. 8 is a schematic view illustrating a configuration of a part of the printer of the image forming apparatus according to the first embodiment as viewed from the front side.
Figure 9:
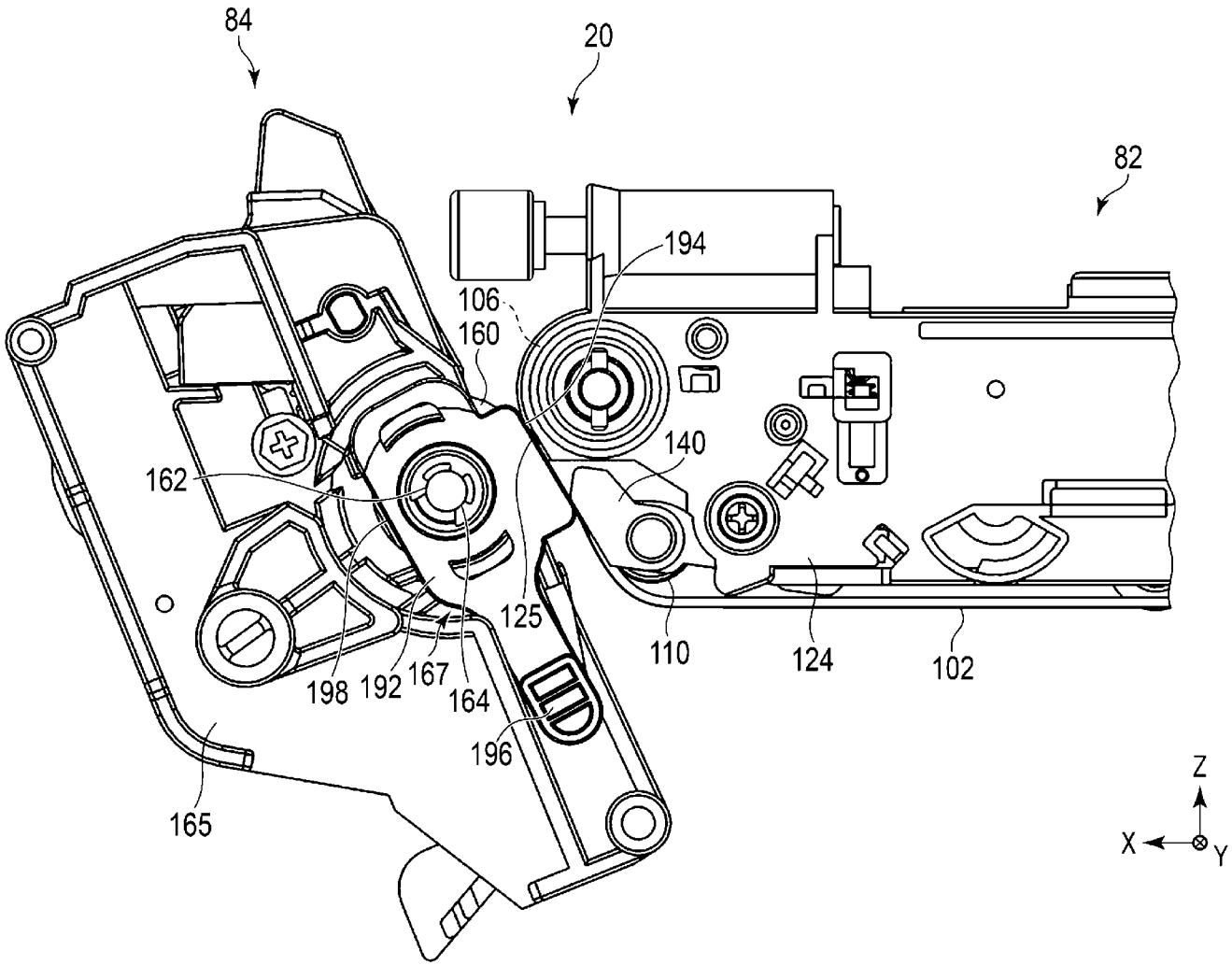
FIG. 9 is a schematic view illustrating a configuration of a part of the printer of the image forming apparatus according to the first embodiment as viewed from the rear side.

FIG. 2 is a perspective view illustrating the apparatus body 12. FIG. 3 illustrates a part of the printer 20 and the side cover 14 of the image forming apparatus 10. FIG. 3 illustrates a state where an outer peripheral surface of the secondary transfer roller 160, which will be described later, is located at an abutting position where the outer peripheral surface abuts on a transfer belt (image carrier belt) 102. FIG. 4 illustrates a part of the printer 20 of the image forming apparatus 10. FIG. 4 illustrates a state where the outer peripheral surface of the secondary transfer roller 160 is located at an abutting position where the outer peripheral surface abuts on the transfer belt 102. FIG. 5 illustrates a part of the printer 20 of the image forming apparatus 10. FIG. 5 illustrates a state where the outer peripheral surface of the secondary transfer roller 160 is located at a separating position where the outer peripheral surface is separated from the transfer belt 102. FIG. 6 is a schematic view of a part of the printer 20 illustrated in FIG. 4 of the image forming apparatus 10 as viewed from the front side. FIG. 7 is a schematic view of a part of the printer 20 illustrated in FIG. 4 of the image forming apparatus 10 as viewed from the rear side. FIG. 8 is a schematic view of a part of the printer 20 illustrated in FIG. 5 of the image forming apparatus 10 as viewed from the front side. FIG. 9 is a schematic view of a part of the printer 20 illustrated in FIG. 5 of the image forming apparatus 10 as viewed from the rear side.

As illustrated in FIG. 2, the apparatus body 12 is a skeleton of the image forming apparatus 10. The apparatus body 12 includes a front frame 32 and a rear frame 34. The front frame 32 is located on the +Y-side of the printer 20. The rear frame 34 is located on the −Y-side of the printer 20. The front frame 32 and the rear frame 34 are coupled to each other by a coupling portion 36 extending along the Y-axis.

As illustrated in FIGS. 1 and 3, the side cover 14 is located at an end portion on the +X-side of the apparatus body 12. The front surface on the +X-side of the side cover 14 is the side surface on the +X-side of the image forming apparatus 10. The side cover 14 rotates in a predetermined angle range around an axis of the opening and closing shaft parallel to the Y-axis. The side cover 14 is opened and closed with respect to the apparatus body 12 by the user operating an operation unit such as a handle or a lever.

As illustrated in FIG. 1, the sheet supply unit 22 is located on the −Z-side below the apparatus body 12. The conveyance unit 24 is located in the upper right direction (+X-side and +Z-side) of the sheet supply unit 22. The printer 20 is located in the upward direction (+Z-side) of the sheet supply unit 22. The control unit 26 and a discharge tray 28 are located in the upward direction (+Z-side) of the printer 20.

The control panel 16 and the scanner unit 18 are located on the +Z-side above the upper end of the apparatus body 12.

The sheet supply unit 22 includes, for example, a plurality of paper feed cassettes 42 accommodating a large number of sheets 44. The sheet supply unit 22 picks up the sheet 44 required for image formation one by one from each paper feed cassette 42. The sheet supply unit 22 supplies the picked-up sheet 44 to the conveyance unit 24.

The conveyance unit 24 includes a conveyance roller 52 and a registration roller 54. The conveyance roller 52 and the registration roller 54 convey the sheet 44 supplied from the paper feed cassette 42 of the sheet supply unit 22 to the printer 20.

The conveyance unit 24 switches a closed position (use position) and an open position (maintenance position) of the conveyance unit 24 according to a positional relationship between the apparatus body 12 and the side cover 14. A portion on the −X-side of the conveyance unit 24 is located in the apparatus body 12. A portion on the +X-side of the conveyance unit 24 is located in the side cover 14.

The registration roller 54 includes a first roller 55 located on the −X-side on the apparatus body 12 side and a second roller 56 located on the +X-side on the side cover 14 side with the conveyance unit 24 of the sheet 44 interposed therebetween. The first roller 55 is rotationally driven by a drive unit. The second roller 56 moves with respect to the first roller 55. The second roller 56 abuts on the first roller 55 when the side cover 14 is closed with respect to the apparatus body 12. The second roller 56 is separated from the first roller 55 when the side cover 14 is opened with respect to the apparatus body 12. The registration roller holding portion 57 is located in the side cover 14. The registration roller holding portion 57 includes an urging member 58, for example, a spring that presses the second roller 56 against the first roller 55 on the apparatus body 12 side by an urging force.

The printer 20 transfers and fixes an image read by, for example, the scanner unit 18 to the sheet 44 that is conveyed through the conveyance unit 24. The conveyance unit 24 discharges the sheet 44 on which the image is fixed by the printer 20 to the discharge tray 28.

The printer 20 includes image forming units 62, 64, 66, and 68, toner cartridges 72, 74, 76, and 78, an exposure unit 80, a transfer unit 82, a secondary transfer roller unit 84, and a fixing unit 86.

The image forming units 62, 64, 66, and 68, the toner cartridges 72, 74, 76, and 78, the exposure unit 80, the transfer unit 82, and the fixing unit 86 of the printer 20 are located in the apparatus body 12. The apparatus body 12 restricts a movement to the ±X-side and the ±Z-side in a state where the image forming units 62, 64, 66, and 68, the toner cartridges 72, 74, 76, and 78, the exposure unit 80, the transfer unit 82, and the fixing unit 86 are located in the apparatus body 12.

The toner cartridges 72, 74, 76, and 78 of the printer contain yellow, magenta, cyan, and black toners, respectively. The toner cartridges 72, 74, 76, and 78 supply the toners to the image forming units 62, 64, 66, and 68, respectively, by means of toner supply pipes. The image forming units 62, 64, 66, and 68 form an image (toner image) using different toners supplied from the toner cartridges 72, 74, 76, and 78, respectively. That is, the image forming units 62, 64, 66, and 68 form toner images of yellow, magenta, cyan, and black, respectively. The image forming units 62, 64, 66, and 68 have the same configuration except for the difference of toner to be used.

Each of the image forming units 62, 64, 66, and 68 includes a photoreceptor drum 92, a charger 94, a developing device 96, a cleaner 98, and a destaticizer.

The photoreceptor drum 92 is an image carrier on which a latent image is formed. The photoreceptor drum 92 includes a photoconductor on the outer peripheral surface thereof. The charger 94 uniformly charges the outer peripheral surface of the photoreceptor drum 92.

The developing device 96 develops an electrostatic latent image formed on the photoreceptor drum 92 with toner to forma toner image. The printer 20 primarily transfers the formed toner image to the transfer belt 102, which will be described later, in the transfer unit 82. The cleaner 98 removes the toner adhering to the photoreceptor drum 92 after the primary transfer.

The exposure unit 80 includes a light source such as a laser or an LED. Image information respectively corresponding to yellow, magenta, cyan, and black is supplied to the exposure unit 80. The exposure unit 80 selectively irradiates the photoreceptor drums 92 of the image forming units 62, 64, 66, and 68 with light according to the image information. The image forming units 62, 64, 66, and 68 form electrostatic latent images corresponding to yellow, magenta, cyan, and black on the outer peripheral surfaces of the photoreceptor drums 92, respectively.

As illustrated in FIGS. 1, 4, and 5, the transfer unit 82 includes a transfer unit body 100, a transfer belt 102, a transfer belt roller 104, a secondary transfer facing roller 106, a support roller 108, a belt suspension roller 110, and four primary transfer rollers 112.

The transfer belt 102, the transfer belt roller 104, the secondary transfer facing roller 106, the support roller 108, the belt suspension roller 110, and the four primary transfer rollers 112 are located in the transfer unit body 100.

The transfer belt 102 is an endless belt. The transfer belt 102 is an intermediate transfer body that forms a toner image by the image forming units 62, 64, 66, and 68.

The transfer belt roller 104, the secondary transfer facing roller 106, the support roller 108, and the belt suspension roller 110 apply tension to the transfer belt 102 to support the transfer belt 102. The transfer belt roller 104, the secondary transfer facing roller 106, the support roller 108, and the belt suspension roller 110 rotate around a central axis thereof parallel to the Y-axis. The transfer belt roller 104 rotates the transfer belt 102 in the direction of arrow A by rotation. The secondary transfer facing roller 106, the support roller 108, and the belt suspension roller 110 rotate in accordance with the rotation of the transfer belt 102.

The image forming units 62, 64, 66, and 68 are located in this order along the direction of the arrow A in which the transfer belt 102 rotates.

The primary transfer rollers 112 face the image forming units 62, 64, 66, and 68, respectively, via the transfer belt 102. A transfer bias is applied to the primary transfer roller 112 in synchronization with the photoreceptor drum 92. Each primary transfer roller 112 primarily transfers each of the toner images formed on the photoreceptor drums 92 of the image forming units 62, 64, 66, and 68 to the transfer belt 102. The formation of the toner image by the image forming units 62, 64, 66, and 68 and the movement of the transfer belt 102 are synchronized. The image forming units 62, 64, 66, and 68 superimpose toner images and transfer the toner images to the transfer belt 102.

The transfer unit 82 includes the cleaner 114. The cleaner 114 removes the toner adhering to the transfer belt 102.

As illustrated in FIGS. 6 to 9, the transfer unit body 100 of the transfer unit 82 includes a first cover 122 and a second cover 124. The first cover 122 and the second cover 124 cover at least a part of each of the transfer belt 102, the secondary transfer facing roller 106, and the belt suspension roller 110. The first cover 122 covers the +Y-side end portion, which is the front side portion of the transfer unit 82. The first cover 122 faces the front frame 32 of the apparatus body 12. The front frame 32 may support the first cover 122. The second cover 124 covers the −Y-side end portion, which is the rear side portion of the transfer unit 82. The second cover 124 faces the rear frame 34 of the apparatus body 12. The rear frame 34 may support the second cover 124. The first cover 122 and the second cover 124 expose the transfer belt 102 along the outer peripheral surface of the secondary transfer facing roller 106.

The first cover 122 includes an abutting portion 123 that abuts on a first convex portion 184 of a first rotating body 166, which will be described later. The abutting portion 123 is located on the +X-side of the transfer belt 102. The second cover 124 includes an abutting portion 125 that abuts on a second convex portion 194 of a second rotating body 167 described later. The abutting portion 125 is located on the +X-side of the transfer belt 102. The first cover 122 has appropriate rigidity to prevent contact with the transfer belt 102 in a state where the first convex portion 184 of the first rotating body 166 abuts on the abutting portion 123. The second cover 124 has appropriate rigidity to prevent contact with the transfer belt 102 in a state where a second convex portion 194 of a second rotating body 167 abuts on the abutting portion 125. The first cover 122 and the second cover 124 are formed of an appropriate material, for example, a resin material, a metal material, and the like.

As illustrated in FIGS. 4 and 5, the transfer unit 82 includes an adjustment portion 130. The adjustment portion 130 adjusts tension applied to the transfer belt 102 in order to prevent the transfer belt 102 from being elongated. The adjustment portion 130 is located in the transfer unit body 100. The adjustment portion 130 includes an arm 132 supported by a rotating shaft 134 parallel to the Y-axis and an urging member 136 between the transfer unit body 100 and the arm 132, on the transfer unit body 100. The arm 132 extends, for example, along the X-axis. The arm 132 rotates with respect to the transfer unit body 100 around the axis of the rotating shaft 134 parallel to the Y-axis. The end portion on the +X-side of the arm 132 supports the belt suspension roller 110. The belt suspension roller 110 suspends the transfer belt 102. The belt suspension roller 110 rotates around the axis of the rotating shaft parallel to the Y-axis at the end portion on the +X-side of the arm 132. The urging member 136 is located between the transfer unit body 100 and the arm 132. The urging member 136 pulls, for example, the other end of the arm 132. The urging member 136 applies an urging force from the inside to the outside of the transfer belt 102 by the belt suspension roller 110.

As illustrated in FIGS. 7 and 9, the transfer unit 82 includes a support member 140 that supports the belt suspension roller 110. The support member 140 is located on the −Y-side of the transfer belt 102. The support member 140 moves between a protruding position at which the support member 140 protrudes to the +X-side of the transfer belt 102 and a pulling-in position at which the support member 140 is pulled in to the −X-side of the transfer belt 102. The support member 140 moves together with the belt suspension roller 110.

The secondary transfer roller unit 84 of the printer 20 is located in the side cover 14. When the side cover 14 rotates around the axis of the opening and closing shaft toward the +X-side, the secondary transfer roller unit 84, which is a portion on the +X-side of the conveyance unit 24, moves together with the side cover 14. In this case, the side cover 14 is in the open position, and the portion on the −X-side of the conveyance unit 24 is exposed. When the side cover 14 is in the closed position, the secondary transfer roller unit 84 is urged to the −X-side by, for example, the registration roller holding portion 57 that urges the second roller 56 of the registration roller 54 to the −X-side. The secondary transfer roller unit 84 is urged to the −X-side by an urging member 216 that urges the conveyance roller 214 of the conveyance path 206, which will be described later, of the sheet 44. The secondary transfer roller unit 84 is urged to the −X-side by other urging members.

The secondary transfer roller unit 84 includes a secondary transfer roller 160, a secondary transfer roller frame 165 that holds the secondary transfer roller 160, and rotating bodies 166 and 167 that rotate around the axis of the rotating shaft at the end portion of the rotating shaft of the secondary transfer roller 160.

The secondary transfer roller 160 configures a secondary transfer unit, that transfers the toner image primarily transferred to the transfer belt 102 to the sheet 44, in cooperation with the secondary transfer facing roller 106. The secondary transfer roller 160 faces the secondary transfer facing roller 106 via the transfer belt 102. The outer peripheral surface of the secondary transfer roller 160 comes into contact with the transfer belt 102. The secondary transfer roller 160 rotates in accordance with the circulation of the transfer belt 102. A transfer bias is applied between the secondary transfer roller 160 and the secondary transfer facing roller 106. The secondary transfer roller 160 transfers the toner image on the transfer belt 102 to the sheet 44.

The secondary transfer roller frame 165 holds the secondary transfer roller 160 so as to rotate. The secondary transfer roller frame 165 is supported by the side cover 14. For that reason, the secondary transfer roller frame 165 moves with respect to the apparatus body 12 together with the side cover 14.

The secondary transfer roller frame 165 includes a first conveyance guide portion 172 at the lower portion of the side surface on the −X-side. The secondary transfer roller frame 165 includes a second conveyance guide portion 174 at the upper portion of the side surface on the −X-side.

When the side cover 14 is closed with respect to the apparatus body 12, the first conveyance guide portion 172 forms a part of the conveyance unit 24 in cooperation with the apparatus body 12, and serves as a guide for conveying the sheet 44 to the printer 20. When the side cover 14 is closed with respect to the apparatus body 12, the second conveyance guide portion 174 forms a part of the conveyance unit 24 in cooperation with the apparatus body 12 side, and serves as a guide for conveying the sheet 44 from the printer 20 to the fixing unit 86.

The secondary transfer roller frame 165 includes a secondary transfer roller holding portion 176 between the first conveyance guide portion 172 and the second conveyance guide portion 174. The secondary transfer roller holding portion 176 is opened in the −X direction and is formed in a concave shape for accommodating the secondary transfer roller 160.

As illustrated in FIGS. 6 and 8, the first rotating body 166 is fixed to an end portion (first end portion) 163 of the rotating shaft 162 on the +Y-side of the secondary transfer roller 160.

The first rotating body 166 includes a first holding member 182 that holds the secondary transfer roller 160 on the secondary transfer roller frame 165, and the first convex portion 184 located on the first holding member 182 and rotating together with the first holding member 182. A first lever 186 is further located on the first holding member 182.

The first holding member 182 and the first convex portion 184 are integrally molded. The first convex portion 184 protrudes in a direction intersecting the central axis of the rotating shaft 162 of the secondary transfer roller 160 with respect to the first holding member 182. More preferably, the first convex portion 184 protrudes in a direction orthogonal to the central axis of the rotating shaft 162 of the secondary transfer roller 160 with respect to the first holding member 182. The first convex portion 184 has an appropriate length along the direction in which the first lever 186 extends.

The first holding member 182 has a side (second portion) 188 opposite to the protruding direction of the first convex portion 184 (first portion) with respect to the central axis of the rotating shaft 162 of the secondary transfer roller 160. The distance (second distance) between this side 188 and the central axis of the rotating shaft 162 of the secondary transfer roller 160 is shorter than the distance (first distance) between a side of a tip end of the first convex portion 184 and the central axis of the rotating shaft 162 of the secondary transfer roller 160.

The first rotating body 166 rotates in a range of, for example, approximately 180 degrees with respect to the secondary transfer roller 160 and the secondary transfer roller frame 165. When the first rotating body 166 rotates, the first lever 186 passes through a position on the +X-side with respect to the +X-side end portion of the transfer unit 82. As illustrated in FIG. 6, the first convex portion 184 is separated from the abutting portion 123 of the first cover 122, and the side 188 opposite to the first convex portion 184 is directed to the abutting portion 123 of the first cover 122, and makes the outer peripheral surface of the secondary transfer roller 160 abut on the transfer belt 102. The side 188 opposite to the first convex portion 184 faces the abutting portion 123 in a state of being separated from the abutting portion 123 of the first cover 122. This posture is a first position as the posture of the first rotating body 166. As illustrated in FIG. 8, the first convex portion 184 abuts on the abutting portion 123 of the first cover 122, and separates the outer peripheral surface of the secondary transfer roller 160 from the transfer belt 102. This posture is a second position as the posture of the first rotating body 166. The first rotating body 166 rotates 180 degrees around the central axis of the rotating shaft 162 of the secondary transfer roller 160 from the first position to take the second position.

As illustrated in FIGS. 7 and 9, the second rotating body 167 is fixed to the end portion (second end portion) 164 of the rotating shaft 162 on the −Y-side of the secondary transfer roller 160. The end 164 is located on the opposite side of the end 163. The first rotating body 166 and the second rotating body 167 are fixed to the same rotating shaft 162. For that reason, the first rotating body 166 and the second rotating body 167 rotate together.

The second rotating body 167 includes a second holding member 192 that holds the secondary transfer roller 160 on the secondary transfer roller frame 165, and a second convex portion 194 located on the second holding member 192 and rotating together with the second holding member 192. A second lever 196 is further located on the second holding member 192.

The second holding member 192 and the second convex portion 194 are integrally molded. The second convex portion 194 protrudes in a direction intersecting the central axis of the rotating shaft 162 of the secondary transfer roller 160 with respect to the second holding member 192. More preferably, the second convex portion 194 protrudes in a direction orthogonal to the central axis of the rotating shaft 162 of the secondary transfer roller 160 with respect to the second holding member 192. The second convex portion 194 has an appropriate length along the direction in which the second lever 196 extends. The second convex portion 194 presses the abutting portion 125 and also presses the support member 140. That is, the second convex portion 194 has a length that amounts to abutment of the second convex portion 194 on the transfer unit 82 and the support member 140.

The second holding member 192 has a side (fourth portion) 198 opposite to the protruding direction of the second convex portion 194 (third portion) with respect to the central axis of the rotating shaft 162 of the secondary transfer roller 160. The distance (fourth distance) between this side 198 and the central axis of the rotating shaft 162 of the secondary transfer roller 160 is shorter than the distance (third distance) between a side of a tip end of the second convex portion 194 and the central axis of the rotating shaft 162 of the secondary transfer roller 160.

The second rotating body 167 rotates in a range of, for example, approximately 180 degrees with respect to the secondary transfer roller 160 and the secondary transfer roller frame 165. When the second rotating body 167 rotates, the second lever 196 passes through a position on the +X-side with respect to the +X-side end portion of the transfer unit 82. For that reason, as illustrated in FIG. 7, the second convex portion 194 is separated from the abutting portion 125 of the second cover 124, and makes the outer peripheral surface of the secondary transfer roller 160 abut on the transfer belt 102). As illustrated in FIG. 9, the second convex portion 194 abuts on the abutting portion 125 of the second cover 124, and separates the outer peripheral surface of the secondary transfer roller 160 from the transfer belt 102.

Figure 10:
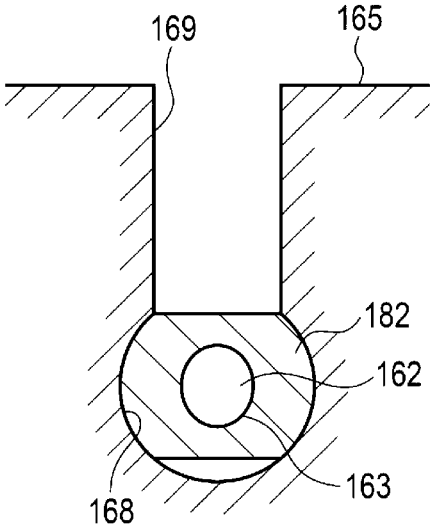
FIG. 10 is a schematic view illustrating a state where a first holding member of a first rotating body of a secondary transfer roller unit is engaged with a transfer roller frame.
Figure 11:
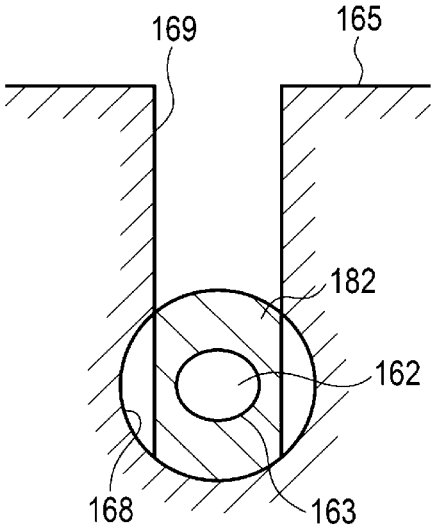
FIG. 11 is a schematic view illustrating a state where the first holding member of the first rotating body of the secondary transfer roller unit is disengaged from the transfer roller frame.

As illustrated in FIGS. 10 and 11, the secondary transfer roller frame 165 includes a concave engagement portion 168 with which the first holding member 182 of the first rotating body 166 is engaged and a slit 169 continuous with the engagement portion 168. The first holding member 182 is rotatable in the engagement portion 168 together with the rotating shaft 162 of the secondary transfer roller 160. The first holding member 182 is movable from the engagement portion 168 to the slit 169 in a predetermined orientation. When the first holding member 182 comes out of the secondary transfer roller frame 165 through the slit 169, the first holding member 182 separates from the secondary transfer roller frame 165. The relationship between the second holding member 192 of the second rotating body 167 and the secondary transfer roller frame 165 is the same as the relationship between the first holding member 182 of the first rotating body 166 and the secondary transfer roller frame 165.

As illustrated in FIG. 10, when the first lever 186 of the first rotating body 166 is in the first position illustrated in FIG. 6, the first holding member 182 of the first rotating body 166 engages with the secondary transfer roller frame 165. When the second lever 196 of the second rotating body 167 is in the first position illustrated in FIG. 7, the second holding member 192 of the second rotating body 167 engages with the secondary transfer roller frame 165.

Similarly, when the first lever 186 of the first rotating body 166 is in the second position illustrated in FIG. 8, the first holding member 182 of the first rotating body 166 engages with the secondary transfer roller frame 165. When the second lever 196 of the second rotating body 167 is in the second position illustrated in FIG. 9, the second holding member 192 of the second rotating body 167 engages with the secondary transfer roller frame 165.

As illustrated in FIG. 11, during the transition of the first rotating body 166 from the first position to the second position, or from the second position to the first position, the first holding member 182 of the first rotating body 166 can be disengaged from the secondary transfer roller frame 165. During the transition of the second rotating body 167 from the first position to the second position, or from the second position to the first position, the second holding member 192 of the second rotating body 167 can be disengaged from the secondary transfer roller frame 165.

For that reason, when the first holding member 182 and the second holding member 192 take the first position and the second position, the first holding member 182 and the second holding member 192 engage with the transfer roller frame 165. When the first holding member 182 and the second holding member 192 take an intermediate position between the first position and the second position, the first holding member 182 and the second holding member 192 disengage from the transfer roller frame 165. When the first holding member 182 of the first rotating body 166 and the second holding member 192 of the second rotating body 167 are in a posture rotated by, for example, 90 degrees around the central axis of the rotating shaft 162 of the secondary transfer roller 160 from the first position, the first holding member 182 of the first rotating body 166 and the second holding member 192 of the second rotating body 167 are disengaged from the secondary transfer roller frame 165, and can be disengaged from the secondary transfer roller frame 165 together with the secondary transfer roller 160.

As illustrated in FIG. 1, the fixing unit 86 is located above the transfer unit 82 and the secondary transfer roller unit 84. The fixing unit 86 applies heat and pressure to the sheet 44 to which the toner image is secondarily transferred. The fixing unit 86 fixes the secondary transferred toner image onto the sheet 44 by the heat and pressure.

Above the fixing unit 86, a conveyance direction switching unit 202 for switching the conveyance direction of the sheet 44 is located.

Above the conveyance direction switching unit 202, a conveyance path 204 for discharging the sheet 44 to the −X-side is formed. Below the outlet on the −X-side of the conveyance path 204, the discharge tray 28 on which the sheet 44 discharged from the conveyance path 204 is placed is located.

A conveyance path 206 for conveying the sheet 44 from the conveyance direction switching unit 202 to the registration roller 54 is located in the side cover 14 on the +X-side of the conveyance direction switching unit 202 between the conveyance direction switching unit 202 and the conveyance roller 52. The conveyance path 206 is used, for example, for inverting the sheet 44 having an image formed on the surface thereof and feed the sheet 44 to the registration roller 54 when performing double-sided printing.

The conveyance path 206 includes a pair or a plurality of pairs of conveyance rollers 212, 214. One conveyance roller 212 is located in the secondary transfer roller unit 84. The other conveyance roller 214 is located in the side cover 14. The conveyance roller 212 on the −X-side and the conveyance roller 214 on the +X-side abuts on each other to convey the sheet 44. For example, the conveyance roller 214 on the +X-side urges the conveyance roller 212 on the −X-side by the urging member 216 such as a spring between the side cover 14 and the conveyance roller 214. For that reason, the secondary transfer roller unit 84 moves to the +X-side against the urging force of the urging member 216.

Next, an operation of the image forming apparatus 10 will be described.

As illustrated in FIGS. 4, 6, and 7, in the image forming apparatus 10, the outer peripheral surface of the secondary transfer roller 160 is made to abut on the transfer belt 102, for example, when performing printing. In the image forming apparatus 10, the convex portions 184 and 194 of the rotating bodies 166 and 167 are separated from the abutting portions 123 and 125 of the covers 122 and 124. A state where the outer peripheral surface of the secondary transfer roller 160 and the convex portions 184 and 194 of the rotating bodies 166 and 167 are in this position is assumed that the image forming apparatus 10 is in the first position.

As illustrated in FIGS. 5, 8, and 9, in the image forming apparatus 10, for example, when the image forming apparatus 10 is packed and transported, the convex portions 184 and 194 of the rotating bodies 166 and 167 are generally made to abut on the abutting portions 123 and 125 of the covers 122 and 124. In the image forming apparatus 10, the outer peripheral surface of the secondary transfer roller 160 is separated from the transfer belt 102. A state where the convex portions 184 and 194 of the rotating bodies 166 and 167 and the outer peripheral surfaces of the secondary transfer roller 160 are in this position is assumed that the image forming apparatus 10 is in the second position. The switching between the first position and the second position is performed by the rotation of the first rotating body 166 and the second rotating body 167.

It is assumed that the image forming apparatus 10 is in the first position, as illustrated in FIGS. 4, 6, and 7. In this case, in the image forming apparatus 10, the secondary transfer roller unit 84 is urged to the −X-side. For that reason, the secondary transfer roller 160 is in the abutting position at which the secondary transfer roller 160 abuts on the transfer belt 102 and sandwiches the transfer belt 102 together with the secondary transfer facing roller 106. The first rotating body 166 is located at the position illustrated in FIG. 6. The second rotating body 167 is located at the position illustrated in FIG. 7. As illustrated in FIGS. 6 and 7, the convex portions 184 and 194 are located on the +X-side with respect to the rotating shaft 162 of the secondary transfer roller 160. The levers 186 and 196 are located on the +Z-side with respect to the rotating shaft 162 of the secondary transfer roller 160. In the state illustrated in FIG. 4, the belt suspension roller 110 urges the transfer belt 102 from the inside to the outside.

For example, when packing and transporting the image forming apparatus 10, an operator such as a maintainer rotates the lever 186 on the +Z-side of the rotating shaft 162 to the −Z-side with respect to the rotating shaft through the +X-side with respect to the rotating shaft 162. The first rotating body 166 and the second rotating body 167 rotate together.

The first convex portion 184 abuts on the abutting portion 123 of the first cover 122. The second convex portion 194 abuts on the abutting portion 125 of the second cover 124. In the apparatus body 12, the transfer unit 82 is supported on the apparatus body 12 so as not to move to the ±X-side and ±Z-side. For that reason, together with the rotating bodies 166 and 167, the secondary transfer roller 160 moves to the +X-side with respect to the transfer unit 82 against the urging force received by the secondary transfer roller unit 84 toward the −X-side. That is, the secondary transfer roller unit 84 moves to the +X-side with respect to the transfer unit 82. In this case, the secondary transfer roller unit 84 may move to the +X-side, and the +Z-side or the −Z-side with respect to the transfer unit 82. An amount of movement of the secondary transfer roller unit 84 to the +X-side with respect to the transfer unit 82 may be, for example, about several mm to 10 mm. The outer peripheral surface of the secondary transfer roller 160 is separated from the transfer belt 102. For that reason, in the image forming apparatus 10, the outer peripheral surface of the secondary transfer roller 160, which is in the first position, is switched to the second position separated from the transfer belt 102, by the rotation of the first rotating body 166 and the second rotating body 167. For that reason, the secondary transfer roller 160 is in a separating position apart from the transfer belt 102. That is, the secondary transfer roller 160 moves from the abutting position to the separating position.

The support member 140 is pushed toward the +Z-side by the second convex portion 194 of the second rotating body 167 from the position illustrated in FIG. 7 to the position illustrated in FIG. 9 against the urging force of the urging member 136. For that reason, the belt suspension roller 110 coupled to the support member 140 is separated from the inner peripheral surface of the transfer belt 102. Accordingly, when the transfer belt 102 is in the second position, the transfer belt 102 is released from the stretched state.

The image forming apparatus 10 is packaged and transported in a state where the outer peripheral surface of the secondary transfer roller 160 is separated from the transfer belt 102. For that reason, in the image forming apparatus 10, when the image forming apparatus 10 is packed and transported, for example, a load on the outer peripheral surface of the secondary transfer roller 160 due to the abutment of the outer peripheral surface of the secondary transfer roller 160 on the transfer belt 102 is prevented from being generated.

When the image forming apparatus 10 is unpacked and used after being transported, the operator rotates the lever 186 located on the +Z-side of the rotating shaft 162 to the +Z-side with respect to the rotating shaft 162 through the +X-side with respect to the rotating shaft 162. The first rotating body 166 and the second rotating body 167 rotate together.

The convex portion 184 of the first rotating body 166 separates from the abutting portion 123 of the first cover 122. The convex portion 194 of the second rotating body 167 separates from the abutting portion 125 of the second cover 124. In the apparatus body 12, the transfer unit 82 is supported by the apparatus body 12 so as not to move to the +X-side, the −X-side, the +Z-side, and the −Z-side. For that reason, together with the rotating bodies 166 and 167, the secondary transfer roller 160 moves to the −X-side with respect to the transfer unit 82 according to the urging force received by the secondary transfer roller unit 84. That is, the secondary transfer roller unit 84 moves to the −X-side with respect to the transfer unit 82. Then, the outer peripheral surface of the secondary transfer roller 160 abuts on the transfer belt 102. For that reason, the secondary transfer roller 160 moves from the separating position to the abutting position. For that reason, in the image forming apparatus 10, the outer peripheral surface of the secondary transfer roller 160, which is in the second position, is switched to the first position abutted on the transfer belt 102 by the rotation of the first rotating body 166 and the second rotating body 167.

The support member 140 is separated from the second convex portion 194 when pressing by the second convex portion 194 of the second rotating body 167 is released. The belt suspension roller 110 is pushed to the −Z-side according to the urging force of the urging member 136. For that reason, the belt suspension roller 110 coupled to the support member 140 presses the inner peripheral surface of the transfer belt 102. Accordingly, when the transfer belt 102 is in the first position, the transfer belt 102 is stretched.

The image forming apparatus 10 performs a printing process in a state where the outer peripheral surface of the secondary transfer roller 160 abuts on the transfer belt 102.

The image forming apparatus 10 configured in this way switches between the first position and the second position by rotating the rotating bodies 166 and 167 of the secondary transfer roller unit 84. For that reason, in the image forming apparatus 10, a dedicated separating member that separates the outer peripheral surface of the secondary transfer roller 160 from the transfer belt 102 is not required to be used when the image forming apparatus 10 is packed and transported.

In the image forming apparatus 10 of this embodiment, the inner peripheral surface of the transfer belt 102 and the belt suspension roller 110 are brought into contact with each other and separated from each other by being interlocked with the rotating bodies 166 and 167. For that reason, in the image forming apparatus 10, the work of attaching a spacer or the like to the adjustment portion 130 when releasing the tension of the transfer belt 102 by the belt suspension roller 110 or releasing the tension of the transfer belt 102 by the belt suspension roller 110 when being in the second position is not required. In the image forming apparatus 10 of this embodiment, when switching from the second position to the first position, work such as removing and discarding the spacer is also not required.

As described above, according to the image forming apparatus 10 according to this embodiment, the rotating bodies 166 and 167 are attached to the end portions 163 and 164 of the rotating shaft 162 of the secondary transfer roller 160. The covers 122 and 124 are attached to the positions on the +X-side (secondary transfer roller unit 84 side) and +Y-side (front frame 32 side) and the positions on the +X-side (secondary transfer roller unit 84 side) and the −Y-side (rear frame 34 side) of the transfer unit 82. With this configuration, in the image forming apparatus 10, when switching from the first position to the second position, the secondary transfer roller unit 84 can be moved to the +X-side with respect to the transfer unit 82 simply by rotating the rotating bodies 166 and 167. In this case, the outer peripheral surface of the secondary transfer roller 160 can be separated from the transfer belt 102, and the belt suspension roller 110 can be separated from the transfer belt 102. In the image forming apparatus 10, when switching from the second position to the first position, the secondary transfer roller unit 84 can be moved to the −X-side with respect to the transfer unit 82 simply by rotating the rotating bodies 166 and 167. In this case, the outer peripheral surface of the secondary transfer roller 160 can be made to abut on the transfer belt 102, and the belt suspension roller 110 can be made to abut on the transfer belt 102.

When the image forming apparatus 10 is packed and transported, work of rotating the rotating bodies 166 and 167 is performed in the image forming apparatus 10. In this case, the image forming apparatus 10 can be packed and transported and fixed at an appropriate position without using a dedicated member such as a spacer in packing and transporting the image forming apparatus 10.

Accordingly, according to the image forming apparatus 10 according to this embodiment, a dedicated member for packing and transporting the image forming apparatus 10 can be eliminated to save resources.

In the image forming apparatus 10 according to this embodiment, an example in which the second lever 196 is located on the second holding member 192 of the second rotating body 167 was described. If the rotating bodies 166 and 167 are interlocked, the second lever 196 is not always required.

The rotation positions of the rotating bodies 166 and 167 of the image forming apparatus 10 according to this embodiment may be detected by a sensor controlled by the control unit 26. In this case, according to the positions of the rotating bodies 166 and 167, ON/OFF control of the power source of the image forming apparatus 10 and control as to whether or not the image forming apparatus 10 performs printing work can be performed.

An example in which the support member 140 of the image forming apparatus 10 according to this embodiment is located on the −Y-side of the transfer belt 102 was described. The support member 140 may be located on the +Y-side of the transfer belt 102 and may be made to abut on and separated from the first rotating body 166.

In this embodiment, the registration roller holding portion 57 and the urging member 216 are exemplified as the mechanism for urging the secondary transfer roller unit 84 to the −X-side. As the mechanism for urging the secondary transfer roller unit 84 to the −X-side, urging mechanisms at various positions can be used as long as the urging mechanisms are located in the side cover 14.

In this embodiment, an example in which the side cover 14 is located on the +X-side of the apparatus body 12 and the secondary transfer roller unit 84 of the printer 20 is located on the +X-side of the transfer unit 82 was described. The side cover 14 may be located on the −X-side with respect to the apparatus body 12, and the secondary transfer roller unit 84 of the printer 20 may be located on the −X-side of the transfer unit 82.

Second Embodiment

The image forming apparatus 10 according to the second embodiment will be described with reference to FIGS. 12 and 13.

A cover 322 is fixed to the front frame 32 of the apparatus body 12. The cover 322 includes an abutting portion 323. The cover 322 is used instead of the cover 122 described in the first embodiment. Accordingly, the image forming apparatus 10 according to this embodiment does not require the first cover 122 described in the first embodiment. As described above, the member that receives the first convex portion 384 of the first rotating body 166 of the image forming apparatus 10 may be located in the transfer unit 82 or in the apparatus body 12.

In the first holding member 182 of the rotating body 166, instead of the first convex portion 184 described in the first embodiment, a first convex portion 384 that protrudes to the +Y-side with respect to the first holding member 182 is provided.

Figure 12:
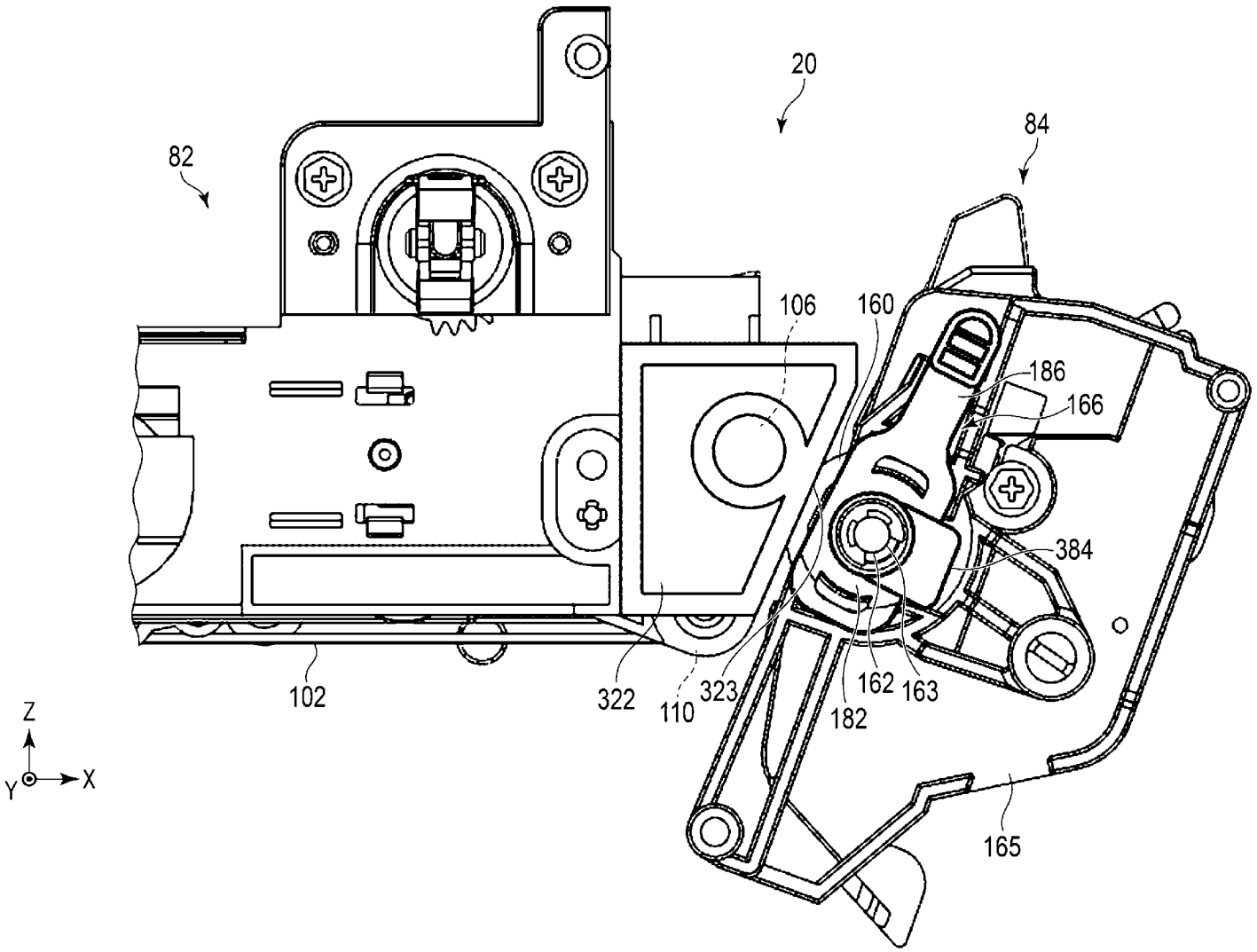
FIG. 12 is a schematic view illustrating a configuration in which a part of a printer of an image forming apparatus according to a second embodiment is viewed from the front side.
Figure 13:
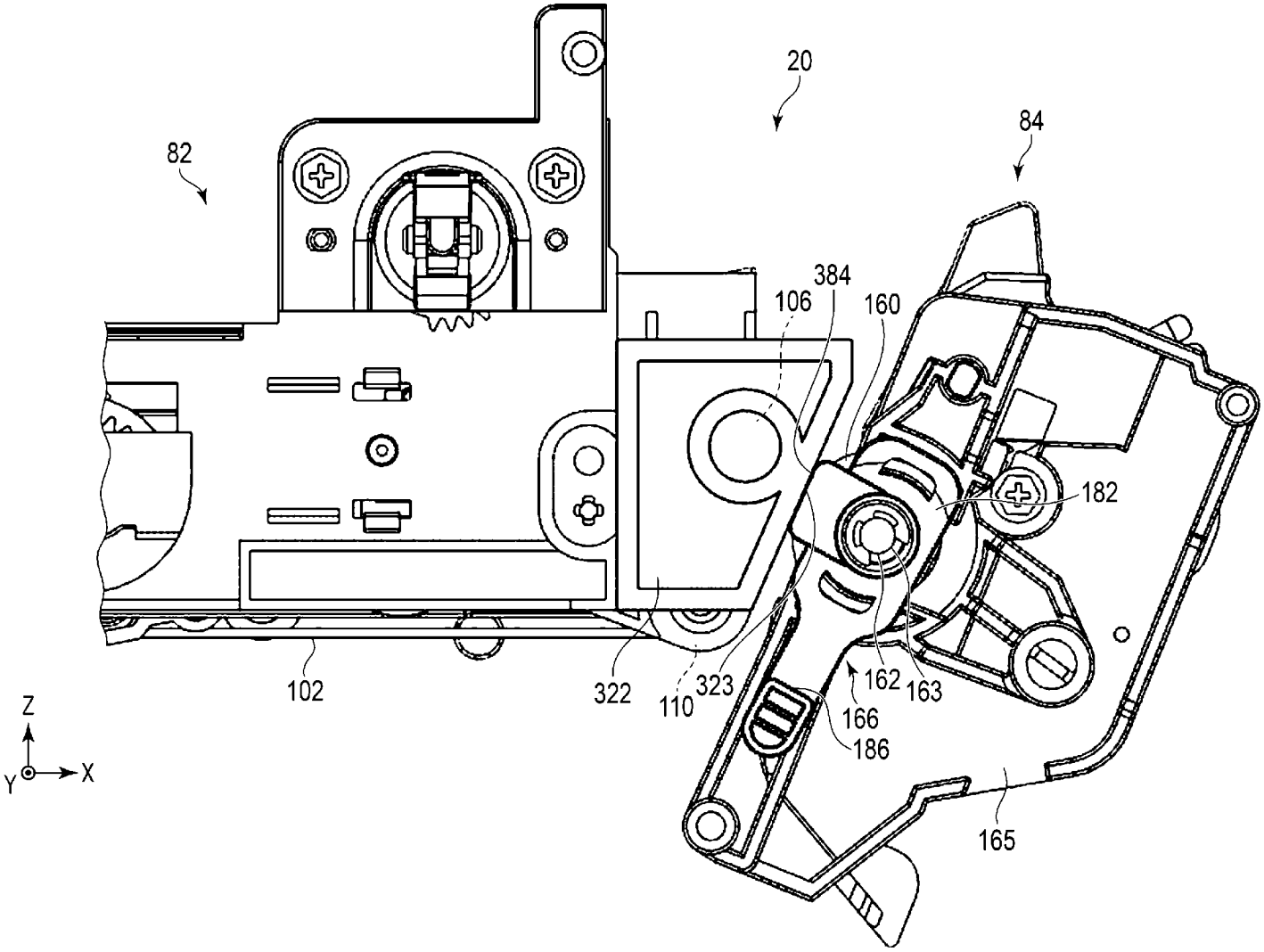
FIG. 13 is a schematic view illustrating a configuration of a part of the printer of the image forming apparatus according to the second embodiment as viewed from the front side.

As illustrated in FIG. 12, when the rotating body 166 is in the first position, the outer peripheral surface of the secondary transfer roller 160 abuts on the transfer belt 102. As illustrated in FIG. 13, when the rotating body 166 is in the second position, the outer peripheral surface of the secondary transfer roller 160 is separated from the transfer belt 102.

For that reason, when the image forming apparatus 10 according to this embodiment is packed and transported, for example, a load on the outer peripheral surface of the secondary transfer roller 160 due to the abutment of the outer peripheral surface of the secondary transfer roller 160 on the transfer belt 102 is prevented from being generated.

Therefore, according to the image forming apparatus 10 according to this embodiment, the dedicated member for packing and transporting the image forming apparatus 10 can be eliminated to save resources.

In this embodiment, an example in which the cover 322 is fixed to the front frame 32, instead of the first cover 122 described in the first embodiment, was described. Instead of the second cover 124 described in the first embodiment, a fixing member corresponding to the second cover 124 may be fixed to the rear frame 34.

According to at least one embodiment described above, the image forming apparatus 10 capable of eliminating a dedicated member when being packed and transported and saving resources can be provided.

Appendix 1

A printer of an image forming apparatus that includes a transfer belt, a transfer facing roller on which the transfer belt is hung, a transfer unit body provided with the transfer belt and the transfer facing roller, a transfer roller configured to rotate with respect to a side cover of the image forming apparatus and move between an abutting position where the transfer roller abuts on the transfer belt and sandwiches the transfer belt together with the transfer facing roller and a separating position where the transfer roller separates from the transfer belt, a cover located on the transfer unit body and covers a portion on the side cover side portion of the transfer belt on an end portion side of the transfer facing roller, a rotating body configured to regulate a movement of the transfer roller in a direction along a rotating shaft of the transfer roller, include a first portion located at a first distance from the rotating shaft of the transfer roller in a direction intersecting the rotating shaft of the transfer roller and a second portion located at a second distance that is nearer than the first distance, and rotate around the rotating shaft of the transfer roller so as to take a first position for supporting the transfer roller in the separating position by making the first portion abut on the cover in a state where the side cover is closed with respect to the apparatus body, and a second position where the second portion is directed to the cover and the transfer roller is in the abutting position in a state where the side cover is closed with respect to the apparatus body.

While certain embodiments have been described, these embodiments have been presented by way of example only, and are not intended to limit the scope of the inventions. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus, comprising:

an apparatus body;

a transfer belt on which an image is formed;

a transfer facing roller on which the transfer belt is hung;

a transfer unit body comprising the transfer belt and the transfer facing roller;

a side cover configured to open and close with respect to the apparatus body;

a transfer roller configured to rotate with respect to the side cover and move between an abutting position where the transfer roller abuts on the transfer belt and sandwiches the transfer belt together with the transfer facing roller and a separating position where the transfer roller separates from the transfer belt;

a cover that is located on the transfer unit body or the apparatus body and configured to cover a portion on a side cover side of the transfer belt on an end portion side of the transfer facing roller;

a first rotating body comprising a first portion located at a first distance from a rotating shaft of the transfer roller in a direction intersecting the rotating shaft of the transfer roller and a second portion located at a second distance from the rotating shaft that is smaller than the first distance, the first rotating body configured to regulate a movement of the transfer roller in a direction along the rotating shaft of the transfer roller, and rotate around the rotating shaft of the transfer roller so as to assume a first position for supporting the transfer roller in the separating position by making the first portion abut on the cover in a state where the side cover is closed with respect to the apparatus body and a second position where the second portion is directed to the cover and the transfer roller is in the abutting position in a state where the side cover is closed with respect to the apparatus body;

a belt suspension roller configured to suspend the transfer belt;

an adjustment portion configured to apply urging force to the belt suspension roller and adjust tension applied to the transfer belt; and a support member configured to support the belt suspension roller, wherein when the first portion is in the second position, the first portion is separated from the support member and the belt suspension roller is made to abut on the transfer belt by the adjustment portion, and when the first portion is in the first position, the first portion abuts on the support member and separates the belt suspension roller from the transfer belt.

2. The image forming apparatus according to claim 1, wherein when the first portion is in the first position, the first portion abuts on the cover and the support member.

3. The image forming apparatus according to claim 2, wherein when defining a front side and a rear side of the image forming apparatus, the cover is configured to cover a rear side of the transfer belt.

4. The image forming apparatus according to claim 1, wherein the adjustment portion comprises an arm supported so as to rotate on the transfer unit body, and an urging member located between the transfer unit body and the arm.

5. The image forming apparatus according to claim 1, further comprising:

the side cover configured to support a transfer roller frame configured to be supported by the side cover, and the transfer roller frame configured to support the rotating shaft of the transfer roller, wherein the first rotating body comprises a first holding member configured to hold the transfer roller on the transfer roller frame, and a lever located on the first holding member that rotates with respect to the rotating shaft of the transfer roller.

6. The image forming apparatus according to claim 5, wherein the first holding member and the first portion are integrally molded.

7. The image forming apparatus according to claim 1, wherein when defining a front side and a rear side of the image forming apparatus, the cover is configured to cover the front side of the transfer belt.

8. The image forming apparatus according to claim 1, further comprising:

the side cover configured to support a transfer roller frame;

the transfer roller frame configured support the rotating shaft of the transfer roller; and a second rotating body located at a position where the second rotating body sandwiches the transfer roller with the first rotating body and comprising a second holding member that holds the transfer roller on the transfer roller frame, a third portion located at a third distance from the rotating shaft of the transfer roller in a direction intersecting the rotating shaft of the transfer roller and a fourth portion located at a fourth distance that is nearer than the third distance, and the second rotating body configured to rotate around an axis of the rotating shaft of the transfer roller together with the first rotating body, and rotate around the rotating shaft of the transfer roller so as to assume a first position for supporting the transfer roller in the separating position by making the third portion abut on the cover in a state where the side cover is closed with respect to the apparatus body and a second position where the fourth portion is directed to the cover and the transfer roller is in the abutting position in a state where the side cover is closed with respect to the apparatus body, wherein the cover comprises a first cover that covers a front side portion of the transfer belt and a second cover that covers a rear side portion of the transfer belt, and when being in the first position, the first portion is configured to abut on the first cover and the third portion is configured to abut on the second cover.

9. An image forming apparatus, comprising:

an apparatus body;

a transfer belt on which an image is formed;

a transfer facing roller on which the transfer belt is hung;

a transfer unit body comprising the transfer belt and the transfer facing roller;

a side cover configured to open and close with respect to the apparatus body;

a transfer roller configured to rotate with respect to the side cover and move between an abutting position where the transfer roller abuts on the transfer belt and sandwiches the transfer belt together with the transfer facing roller and a separating position where the transfer roller separates from the transfer belt;

a cover that is located on the transfer unit body or the apparatus body and configured to cover a portion on a side cover side of the transfer belt on an end portion side of the transfer facing roller;

a first rotating body comprising a first portion located at a first distance from a rotating shaft of the transfer roller in a direction intersecting the rotating shaft of the transfer roller and a second portion located at a second distance from the rotating shaft that is smaller than the first distance, the first rotating body configured to regulate a movement of the transfer roller in a direction along the rotating shaft of the transfer roller, and rotate around the rotating shaft of the transfer roller so as to assume a first position for supporting the transfer roller in the separating position by making the first portion abut on the cover in a state where the side cover is closed with respect to the apparatus body and a second position where the second portion is directed to the cover and the transfer roller is in the abutting position in a state where the side cover is closed with respect to the apparatus body; and the side cover configured to support a transfer roller frame, the transfer roller frame configured to support the rotating shaft of the transfer roller, wherein the first rotating body comprises a first holding member that holds the transfer roller on the transfer roller frame, when the first rotating body takes the first position or the second position, the first holding member is configured to be engaged with the transfer roller frame, and when the first rotating body takes an intermediate position between the first position and the second position, the first holding member is configured to be disengaged from the transfer roller frame.

10. The image forming apparatus according to claim 9, wherein when the first portion is in the first position, the first portion abuts on the cover and a support member.

11. The image forming apparatus according to claim 9, wherein when defining a front side and a rear side of the image forming apparatus, the cover is configured to cover the front side of the transfer belt.

12. A transfer belt assembly, comprising:

a transfer belt on which an image is formed;

a transfer facing roller on which the transfer belt is hung;

a transfer unit body comprising the transfer belt and the transfer facing roller;

a side cover configured to open and close;

a transfer roller configured to rotate with respect to the side cover and move between an abutting position where the transfer roller abuts on the transfer belt and sandwiches the transfer belt together with the transfer facing roller and a separating position where the transfer roller separates from the transfer belt;

a cover that is located on the transfer unit body and configured to cover a portion on a side cover side of the transfer belt on an end portion side of the transfer facing roller;

a first rotating body comprising a first portion located at a first distance from a rotating shaft of the transfer roller in a direction intersecting the rotating shaft of the transfer roller and a second portion located at a second distance from the rotating shaft that is smaller than the first distance, the first rotating body configured to regulate a movement of the transfer roller in a direction along the rotating shaft of the transfer roller, and rotate around the rotating shaft of the transfer roller so as to assume a first position for supporting the transfer roller in the separating position by making the first portion abut on the cover in a state where the side cover is closed and a second position where the second portion is directed to the cover and the transfer roller is in the abutting position in a state where the side cover is closet;

a belt suspension roller configured to suspend the transfer belt;

an adjustment portion configured to apply urging force to the belt suspension roller and adjust tension applied to the transfer belt; and a support member configured to support the belt suspension roller, wherein when the first portion is in the second position, the first portion is separated from the support member and the belt suspension roller is made to abut on the transfer belt by the adjustment portion, and when the first portion is in the first position, the first portion abuts on the support member and separates the belt suspension roller from the transfer belt.

13. The transfer belt assembly according to claim 12, wherein when the first portion is in the first position, the first portion abuts on the cover and the support member.

14. The transfer belt assembly according to claim 13, wherein when defining a front side and a rear side of the transfer belt assembly, the cover is configured to cover a rear side of the transfer belt.

15. The transfer belt assembly according to claim 12, wherein the adjustment portion comprises an arm supported so as to rotate on the transfer unit body, and an urging member located between the transfer unit body and the arm.

16. The transfer belt assembly according to claim 12, further comprising:

the side cover configured to support a transfer roller frame configured to be supported by the side cover, and the transfer roller frame configured to support the rotating shaft of the transfer roller, wherein the first rotating body comprises a first holding member configured to hold the transfer roller on the transfer roller frame, and a lever located on the first holding member that rotates with respect to the rotating shaft of the transfer roller.

17. The transfer belt assembly according to claim 16, wherein the first holding member and the first portion are integrally molded.

18. The transfer belt assembly according to claim 12, wherein when defining a front side and a rear side of the transfer belt assembly, the cover is configured to cover the front side of the transfer belt.

19. The transfer belt assembly according to claim 12, further comprising:

the side cover configured to support a transfer roller frame, the transfer roller frame configured to support the rotating shaft of the transfer roller, wherein the first rotating body comprises a first holding member that holds the transfer roller on the transfer roller frame, when the first rotating body takes the first position or the second position, the first holding member is configured to be engaged with the transfer roller frame, and when the first rotating body takes an intermediate position between the first position and the second position, the first holding member is configured to be disengaged from the transfer roller frame.

20. The transfer belt assembly according to claim 12, further comprising:

the side cover configured to support a transfer roller frame;

the transfer roller frame configured support the rotating shaft of the transfer roller; and a second rotating body located at a position where the second rotating body sandwiches the transfer roller with the first rotating body and comprising a second holding member that holds the transfer roller on the transfer roller frame, a third portion located at a third distance from the rotating shaft of the transfer roller in a direction intersecting the rotating shaft of the transfer roller and a fourth portion located at a fourth distance that is nearer than the third distance, and the second rotating body configured to rotate around an axis of the rotating shaft of the transfer roller together with the first rotating body, and rotate around the rotating shaft of the transfer roller so as to assume a first position for supporting the transfer roller in the separating position by making the third portion abut on the cover in a state where the side cover is closed and a second position where the fourth portion is directed to the cover and the transfer roller is in the abutting position in a state where the side cover is closed, wherein the cover comprises a first cover that covers a front side portion of the transfer belt and a second cover that covers a rear side portion of the transfer belt, and when being in the first position, the first portion is configured to abut on the first cover and the third portion is configured to abut on the second cover.

* * * * *